US005929744A

United States Patent [19]

Duggal et al.

[11] Patent Number: 5,929,744

[45] Date of Patent: Jul. 27, 1999

[54] CURRENT LIMITING DEVICE WITH AT LEAST ONE FLEXIBLE ELECTRODE

[75] Inventors: Anil Raj Duggal; Minyoung Lee, both of Niskayuna; Harold Jay Patchen, Burnt Hills, all of N.Y.

[73] Assignee: General Electric Company, Schenectady, N.Y.

[21] Appl. No.: 08/801,766

[22] Filed: Feb. 18, 1997

[51] Int. Cl.[6] ..... H01C 7/10

[52] U.S. Cl. ..... 338/22 R; 338/99; 338/104; 338/112; 338/114; 361/126

[58] Field of Search ..... 338/20, 21, 22 R, 338/22 SD, 99, 104, 112, 114, 115, 47; 361/126, 135

[56] References Cited

U.S. PATENT DOCUMENTS

| | | | |
|---|---|---|---|
| 3,226,600 | 12/1965 | Zielasek | 315/209 |
| 3,243,753 | 3/1966 | Kohler | 338/31 |
| 3,648,002 | 3/1972 | Du Rocher | 200/166 C |
| 3,673,121 | 6/1972 | Meyer | 252/511 |
| 4,017,715 | 4/1977 | Whitney et al. | 219/553 |
| 4,101,862 | 7/1978 | Takagi et al. | 338/23 |
| 4,107,640 | 8/1978 | Asano et al. | 338/23 |
| 4,237,441 | 12/1980 | van Konynenburg et al. | 338/22 R |
| 4,292,261 | 9/1981 | Kotani et al. | 264/24 |
| 4,304,987 | 12/1981 | van Konynenburg | 219/431 |
| 4,317,027 | 2/1982 | Middleman et al. | 219/553 |
| 4,583,146 | 4/1986 | Howell | 361/13 |
| 4,685,025 | 8/1987 | Carlomagno | 361/106 |
| 4,890,186 | 12/1989 | Matsubara et al. | 361/103 |
| 5,057,674 | 10/1991 | Smith-Johannsen | 219/553 |
| 5,068,634 | 11/1991 | Shrier | 338/21 |
| 5,166,658 | 11/1992 | Fang et al. | 338/23 |
| 5,247,276 | 9/1993 | Yamazaki | 338/22 R |
| 5,260,848 | 11/1993 | Childers | 361/127 |
| 5,313,184 | 5/1994 | Greuter et al. | 338/21 |
| 5,382,938 | 1/1995 | Hansson et al. | 338/22 R |
| 5,414,403 | 5/1995 | Greuter et al. | 338/22 R |

(List continued on next page.)

FOREIGN PATENT DOCUMENTS

| | | |
|---|---|---|
| 0640995 | 3/1995 | European Pat. Off. . |
| 0713227 | 5/1996 | European Pat. Off. . |
| 0747910 | 12/1996 | European Pat. Off. . |
| 4330607 | 3/1995 | Germany . |
| 9112643 | 8/1991 | WIPO . |
| 9119297 | 12/1991 | WIPO . |
| 9321677 | 10/1993 | WIPO . |
| 9410734 | 5/1994 | WIPO . |
| 9534931 | 12/1995 | WIPO . |
| 9749102 | 12/1997 | WIPO . |

OTHER PUBLICATIONS

Duggal et al., Appl. Phys. lett. 71 (14), Oct. 6, 1997, "High Power Switching Behavior in Electrically Conductive Polymer Composite Materials", pp. 1939–1941.

Ford et al., J. Appl. Phys. 61 (6), Mar. 15, 1987, Positive Temperature Coefficient Resistors as High–Power Pulse Switches: Performance Limitations, Temperature Effects, and Triggering Behavior, pp. 2381–2386.

Duggal et al., Joournal of Applied Physics, vol. 83, No. 4, Feb. 15, 1998, The Initiation of High Current Density Switching in Electrically Conductive Polymer Composite Materials. pp. 2046–2051.

Duggal et al., J. Appl. Phys. 82 (11), Dec. 1, 1997, A Novel High Current Density Switching Effect in Electrically Conductive Polymer Composite Matrials, pp. 5532–5539.

(List continued on next page.)

*Primary Examiner*—Michael L. Gellner
*Assistant Examiner*—Karl Easthom
*Attorney, Agent, or Firm*—Ernest G. Cusick; Noreen C. Johnson

[57] ABSTRACT

A current limiting device has an electrically conductive composite material, an inhomogeneous distribution of resistance structure comprises a conducting filler, and at least two electrodes. At least one of the electrodes is a flexible electrode to maintain contact between the electrode and the composite material, regardless of the consumption of the composite material during a high current condition.

27 Claims, 5 Drawing Sheets

U.S. PATENT DOCUMENTS

| | | | |
|---|---|---|---|
| 5,416,462 | 5/1995 | Demarmels et al. | 338/22 R |
| 5,432,140 | 7/1995 | Sumpter et al. | 502/167 |
| 5,436,274 | 7/1995 | Sumpter et al. | 521/88 |
| 5,451,919 | 9/1995 | Chu et al. | 338/22 R |
| 5,545,679 | 8/1996 | Bollinger, Jr. et al. . | |
| 5,581,192 | 12/1996 | Shea et al. | 324/722 |
| 5,602,520 | 2/1997 | Baiatu et al. | 338/22 R |
| 5,644,283 | 7/1997 | Grosse-Wilde et al. | 338/20 |
| 5,777,541 | 7/1998 | Vekeman . | |

OTHER PUBLICATIONS

"Accurate Placement and Retention of an Amalgam in an Electrodeless Fluorescent Lamp", Borowiec et al., Serial No. 08/448,080 (RD–24425FW) filed May 23, 1995.

CURRENT LIMITING DEVICE WITH AT LEAST ONE FLEXIBLE ELECTRODE

BACKGROUND OF THE INVENTION

1. Field of the Invention

This invention relates to current limiting devices for general circuit protection including electrical distribution and motor control applications. In particular, the invention relates to current limiting devices that are capable of limiting the current in a circuit when a short-circuit occurs.

2. Description of Related Art

There are numerous devices that are capable of limiting the current in a circuit when a short-circuit occurs. One known limiting device includes a filled polymer material which exhibits what is commonly referred to as a PTCR (positive-temperature coefficient of resistance) or PTC effect. U.S. Pat. No. 5,382,938, U.S. Pat. No. 5,313,184, and European Published Patent Application No. 0,640,995 A1 all describe electrical devices relying on PTC behavior. The unique attribute of the PTCR or PTC effect is that at a certain switch temperature the PTCR material undergoes a transformation from a basically conductive material to a basically resistive material. In some of these prior current limiting devices, the PTCR material (typically polyethylene loaded with carbon black) is placed between pressure contact electrodes.

Current limiting devices are used in many applications to protect sensitive components in an electrical circuit from high fault currents. Applications range from low voltage and low current electrical circuits to high voltage and high current electrical distribution systems. An important requirement for many applications is a fast current limiting response to minimize the peak fault current that develops.

In operation, current limiting devices are placed in a circuit to be protected. Under normal circuit conditions, the current limiting device is in a highly conducting state. When a short-circuit occurs, the PTCR material heats up through resistive heating until the temperature is above the switch temperature. At this point, the PTCR material resistance changes to a high resistance state and the short-circuit current is limited. When the short-circuit is cleared, the current limiting device cools down over a time period that may be long to below the switch temperature and returns to the highly conducting state. In the highly conducting state, the current limiting device is again capable of switching to the high resistance state in response to future short-circuit events.

U.S. patent application Ser. No. 08/514,076, filed Aug. 11, 1995, now U.S. Pat. No. 5,614,881, issued Mar. 25, 1997, the entire contents of which are herein incorporated by reference, discloses a current limiting device. This current limiting device relies on a composite material and an inhomogeneous distribution of resistance structure.

Known current limiting devices include conducting composite material comprising a low pyrolysis or vaporization temperature polymeric binder and an electrically conducting filler combined with an inhomogeneous distribution of resistance structure. The switching action of these current limiting devices occurs when joule heating of the electrically conducting filler in the relatively higher resistance part of the composite material causes sufficient heating to cause pyrolysis or vaporization of the binder.

During operation of known current limiting devices, at least one of material ablation and arcing occur at localized switching regions in the inhomogeneous distribution of resistance structure. The ablation and arcing can lead to at least one of high mechanical and thermal stresses on the conducting composite material. These high mechanical and thermal stresses often lead to the mechanical failure of the composite material. For a reliable operation, it is desirable to reduce high mechanical and thermal stresses.

Material ablation and arcing can damage the conducting composite material's surface, and result in craters, voids or spaces formed on the current limiting device's surface at an interface between the electrode and conducting composite material. This formation of craters, voids or spaces leads to an incomplete contact of the electrode and electrically conducting composite material surface after a current limiting event. The resultant current limiting device would then have a higher resistance after a switching event, which of course is not desirable.

SUMMARY OF THE INVENTION

Accordingly, it is desirable to provide a current limiting device that overcomes the above, and other, disadvantages of known current limiting devices.

A current limiting device, as embodied in the invention, comprises at least two electrodes, where at least one of the electrodes is a flexible electrode. The current limiting device also comprises an electrically conducting composite material between the two electrodes and contacting the flexible electrode. The composite material comprises a binder with a low pyrolysis temperature, and an electrically conductive filler. Interfaces are defined between the at least one flexible electrode and composite material, and the at least one flexible electrode and composite material are in contact at the interfaces. Further, an inhomogeneous distribution of resistance structure is located at the interfaces. During a high current condition, such as a short circuit, at least a partial physical separation occurs between the at least one flexible electrode and the composite material at the interface. After the high current condition, contact between the at least one flexible electrode and composite material is returned due to the flexibility of the at least one flexible electrode.

BRIEF DESCRIPTION OF THE DRAWINGS

While the novel features of this invention are set forth in the following description, the invention will now be described from the following detailed description of the invention taken in conjunction with the drawings, in which.

DETAILED DESCRIPTION OF THE INVENTION

Figure 1:
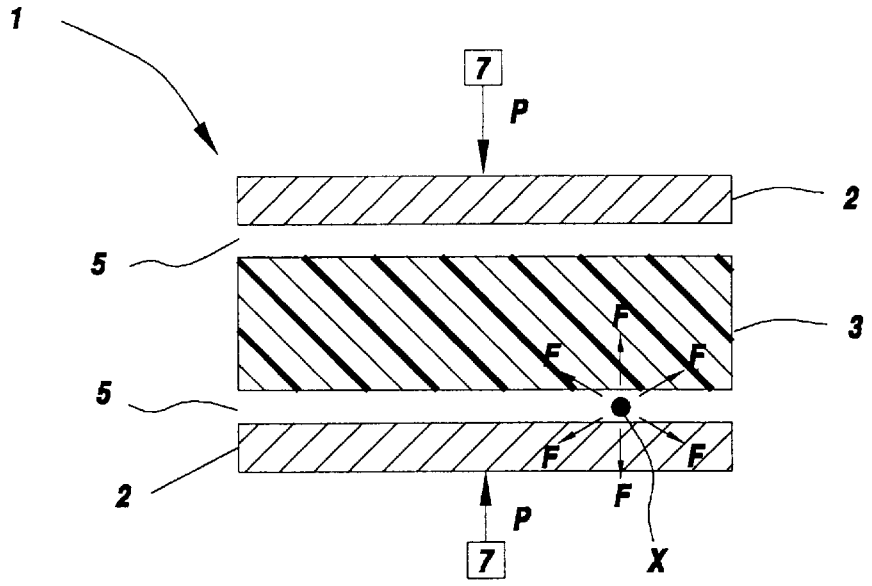
FIG.1 PRIOR ART
FIG. 1 is a side cross-sectional drawing of a conventional current limiting device illustrating localized arcing and ablation.
Figure 2:
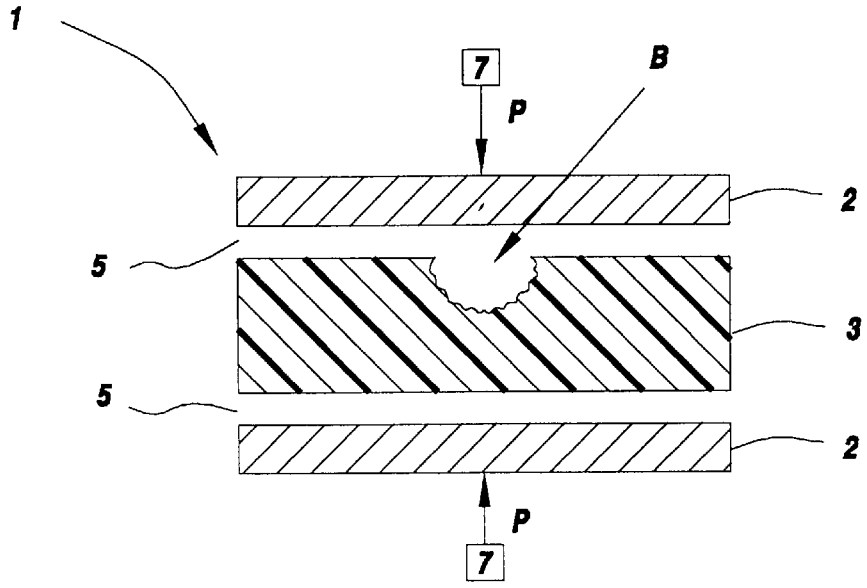
FIG.2 PRIOR ART
FIG. 2 is a side cross-sectional drawing of a conventional current limiting device with a stiff electrode after a switching event.

A conventional current limiting device 1 is generally illustrated in FIGS. 1 and 2. The conventional current limiting device 1 comprises an electrically conductive composite material 3, which comprises at least one of a low pyrolysis temperature and a vaporization temperature; a binder; and an electrically conducting filler combined with an inhomogeneous distribution of resistance structure, and relatively stiff electrodes 2. A compressive pressure or force P may also be applied to the current limiting device 1 by a force applying device 7. For example, and in no way limiting of the invention, the inhomogeneous distribution of resistance may comprise contact resistance, which refers to the resistance that results from the juxtaposition of two surfaces.

The binder is chosen so that significant gas evolution occurs at a low, i.e. less than about 800° C., temperature. The inhomogeneous distribution structure is typically selected so that at least one selected thin layer of the current limiting device has much higher resistance than the rest of the current limiting device.

It is believed that the advantageous results of the conventional current limiting device are obtained because, during a high current condition, adiabatic resistive heating of this selected thin layer followed by rapid thermal expansion and gas evolution from the binding material leads to a partial or complete physical separation of the current limiting device that produces a higher over-all device resistance to electric current flow. Thus, the current limiting device 1 limits the flow of current through the high current condition current path. Other components of the electrical circuit are not harmed by the high current condition.

Various arcing and ablation events occur and are localized at an area X on an electrode 2 and composite material 3 interface 5 during a switching event. These arcing and ablation events effectively create repulsion force(s) F between the electrode 2 and electrically conductive composite material 3, as illustrated in FIG. 1. These events result in at least one of localized mechanical and thermal stresses on the electrically conductive composite material 3 and electrode 2.

Further, a minute portion of the polymer composite conducting material 3 may be consumed by the arcing and ablation. Thus, after a switching event, craters, voids or spaces 8 of various sizes can be found on the surface of the polymer composite conducting material at the interface 5 between the electrode 2 and polymer composite conducting material 3 due to the consumption. With a stiff electrode 2, as in conventional current limiting devices 1, contact between the electrode 2 and polymer composite conducting material 3 may not occur at these craters, voids or spaces 3, as depicted in FIG. 2, because the relative inflexible nature of the stiff electrode 2 will not allow it to re-contact the conductive composite material 3. This lack of contact then leads to an increase in contact resistance due to the contact reduction between the stiff electrode 2 and polymer composite conducting material 3.

When the high current condition is cleared, it is believed that the current limiting device regains some of its low resistance state due to the compressive pressure thereby allowing electrical current to flow normally. However, if craters, voids or spaces 8 occur, there are gaps that stiff electrodes cannot bend across so that the craters, voids or spaces 8 prevent a continuous contact between the stiff electrode 2 and polymer composite conducting material 3. Thus, the utility of a current limiting device will be lessened due to an increased resistance during normal circuit operation.

Therefore, it has been discovered that it is desirable to insure continuous contact between at least one of the electrodes in a current limiting device and polymer composite conducting material. This continuous contact between at least one of the electrodes in a current limiting device and polymer composite conducting material permits a current limiting device to maintain its physical integrity during a switching event and to regain a low resistance condition under normal operating conditions, without significantly impairing or reducing its operation.

Figure 3:
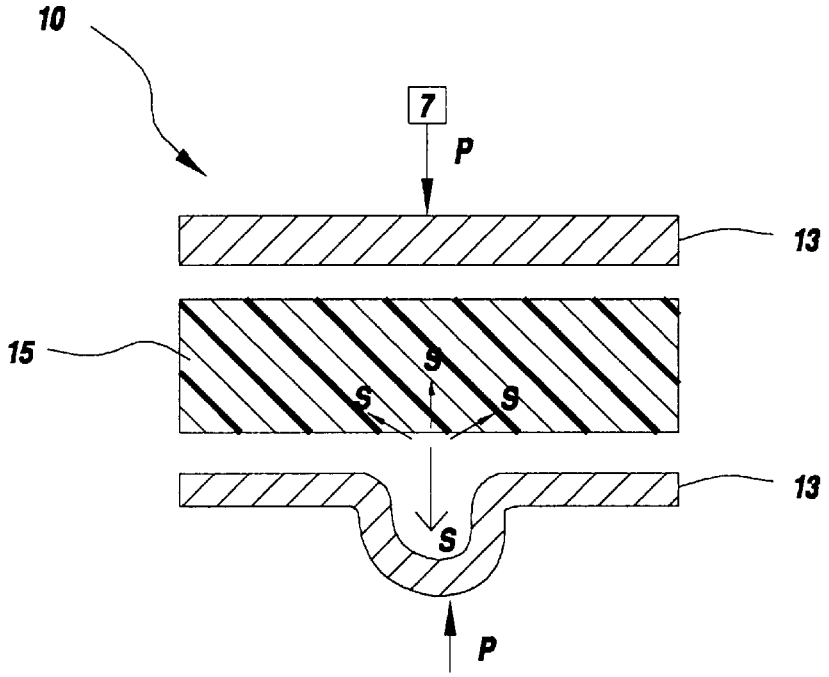
FIG. 3 is a side cross-sectional drawing of a first embodiment of a current limiting device with a flexible electrode.
Figure 4:
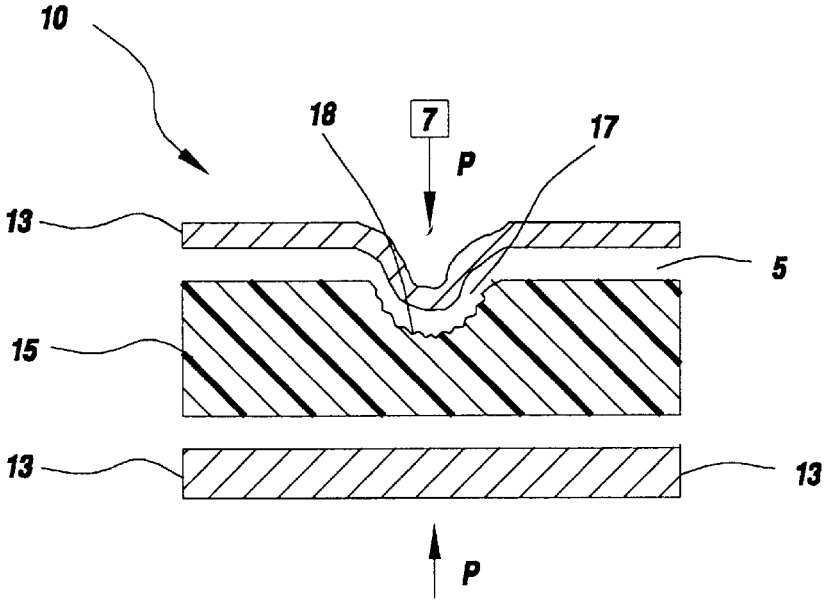
FIG. 4 is a side cross-sectional drawing of a current limiting device illustrating a flexible electrode after a switching event has occurred.

Referring to FIG. 3 and 4, a first embodiment of the current limiting device 10 comprises an electrically conductive composite material 15 and at least one flexible electrode 13. While FIGS. 3 and 4 (and the other embodiments to be described hereinafter) illustrate two flexible electrodes, the scope of the invention includes at least one flexible electrode in the current limiting device.

There is an inhomogeneous distribution of resistance structure in the material throughout the current limiting device 10. For the current limiting device 10 to be reusable, the inhomogeneous resistance structure distribution in the material can be arranged so that at least one thin layer of the current limiting device 10 is positioned perpendicular to a direction of normal current flow, and has a higher resistance than for an average layer of the same size and orientation. The inhomogeneous distribution of resistance structure in the material is preferably arranged so that at least one thin layer positioned perpendicular to the direction of current flow has a resistance at least about ten percent (10%) greater than the average resistance for an average layer of the same size and orientation. The inhomogeneous distribution of resistance structure in the material is preferably positioned proximate the interface of the at least one flexible electrode 13, and electrically conductive composite material 15.

The current limiting device 10 is typically under compressive pressure P in a direction perpendicular to the selected thin high resistance layer, where the compressive pressure may be inherent in the current limiting device 10 or applied by an external apparatus 7, assembly or device. The external apparatus 7 need not be employed, dependent on an extent of inherent resilience in the current limiting device itself. However, such a compressive pressure P insures the contact between the electrodes 13 and conductive composite material 15.

The conductive composite material 15 comprises a low pyrolysis or vaporization temperature binder and an electrically conducting filler combined with inhomogeneous distribution of resistance structure that may be under compressive pressure P. The binder is chosen such that significant amount of gas evolution occurs at a low (less that approximately 800° C.) temperature. The inhomogeneous distribution structure is typically chosen so that at least one selected thin layer of the current limiting device has much higher resistance than the rest of the current limiting device.

The flexible electrodes 13 are formed from known conductive materials, so long as the electrodes 13 provide and maintain a degree of flexibility, as embodied in the invention. The flexible electrodes 13 are generally pliable, compliant, capable of conforming to a surface of the conductive composite material, even if the conductive composite material has irregularities on its surface, and are able to be deformed under pressure. The flexible electrodes 13 are at least formed entirely of a flexible conductive material, in part from a flexible conductive material, and formed of a flexible conductive material at at least a general area where a localized arcing and ablation will occur.

With reference to FIGS. 3 and 4, the operation the current limiting device 10 will be described. The current limiting device 10 is placed with an electrical circuit to be protected and coupled thereto, for example in series. During normal operation, the resistance of the current limiting device 10 is low, i.e., the resistance of the current limiting device 10 is about equal to the resistance of the conductive composite material 15 plus resistance of the flexible electrodes 13 plus contact resistance.

When a high current condition occurs, a high current flows through the current limiting device 10. In the initial stages of the high current condition, the resistive heating of the current limiting device 10 is believed to be adiabatic. Thus, it is believed that the selected thin, resistive layer of the current limiting device 10 heats up much faster than the rest of the current limiting device 10. With a properly designed thin layer, it is believed that the thin layer heats up so quickly that at least one of thermal expansion of and gas evolution from the thin layer cause a separation within the current limiting device 10 at the thin layer.

In the current limiting device 10, it is believed at least one of vaporization and ablation processes cause separation of the flexible electrodes 13 from the conductive composite material 15. In this separated state, it is believed that ablation of the conductive composite material 15 occurs, and arcing between the separated layers of the current limiting device 10 can occur. Further, mechanical and thermal stresses may be created between the flexible electrode 13 and the conductive composite material 15. These stresses are reduced relative to stresses occurring with a stiff electrode, since dynamic deformation of the flexible electrode opposes a build up of mechanical and thermal stresses. Accordingly, there is less likelihood of mechanical failure of the flexible electrode.

A minute portion of the polymer composite conducting material may be consumed by at least one of the arcing and ablation. Thus, after a switching event where a high current condition exists, craters, voids or spaces can be found on the surface of the polymer composite conducting material at the interface of the electrode and polymer composite conducting material. Therefore, with the craters, voids and/or spaces and a stiff electrode, as in FIG. 2, an overall resistance of a current limiting device can be higher, than a current limiting device without craters, voids or spaces.

After the high current condition current is interrupted, a current limiting device without craters, voids and/or spaces would return into its non-separated state, due to compressive pressure that acts to push the separated layers together. However, as illustrated in FIG. 2, after a switching event, craters, voids or spaces can be found on a surface of the polymer composite material at the interface of the stiff electrode and polymer composite conducting material. Thus, the resistance of a current limiting device will increase, at least in part due to the incomplete physical and electrical contact.

With a current limiting device 10, as embodied in the invention, contact between the at least one flexible electrode 13 and the polymer composite material 15 is maintained, even when cratered, spaced or voided regions 17 are present. With a flexible electrode 13 provided for at least one of the electrodes 13 in a current limiting device, there is an increase in physical and electrical contact between the flexible electrode 13 and polymer composite material 15, since the flexible electrode 13 can flex and assume the shape of the cratered surface 18 on the interface 5, as illustrated in FIG. 4. This leads to reduced resistances and enhanced performance of the current limiting device 10 with a flexible electrode 13, compared to a current limiting device without a flexible electrode.

Alternate constructions of the current limiting device, as embodied in the invention, are made by a parallel current path containing a resistor, varistor, or other linear or non-linear elements to achieve goals, such as controlling the maximum voltage that may appear across the current limiting device 10 in a particular circuit. Further, an alternative path can be provided for some of the circuit energy to increase the usable lifetime of the current limiting device.

A binder material for use in the current limiting device as embodied in the invention preferably has a low pyrolysis or vaporization temperature, for example about less than 800° C. Binder materials comprise, but are not limited to, a thermoplastic, for example, polytetrafluoroethylene, poly (ethyleneglycol), polyethylene, polycarbonate, polyimide, polyamide, polymethylmethacrylate, and polyester; a thermoset plastic, for example, epoxy, polyester, polyurethane, phenolic, and alkyd; an elastomer, for example, silicone (polyorganosiloxane), (poly)urethane, isoprene rubber, and neoprene; an organic or inorganic crystal; alone or combined with an electrically conducting filler, such as a ceramic, metal, for example but not limited to, nickel, silver, silver and aluminum, aluminum, and copper; or a semiconductor, for example, carbon black, and titanium dioxide, could also perform effectively in the current limiting device of the invention. Further, a filler material with a particulate or foam structure is also envisioned in this invention.

Third phase fillers can be included in the current limiting device to improve specific properties of the composite material. As embodied in the invention, these third phase fillers include fillers to improve mechanical properties; dielectric properties; or to provide arc-quenching properties or flame-retardant properties. Materials that could be used as a third phase fillers in the composite material comprise: a filler selected from reinforcing fillers, such as fumed silica; or extending fillers, such as precipitated silica and mixtures thereof. Other fillers include titanium dioxide, lithopone, zinc oxide, diatomaceous silicate, silica aerogel, iron oxide, diatomaceous earth, calcium carbonate, silazane treated silicas, silicone treated silicas, glass fibers, magnesium oxide, chromic oxide, zirconium oxide, alpha-quartz, calcined clay, carbon, graphite, cork, cotton sodium bicarbonate, boric acid, and alumina-hydrate.

Other additives may be included in the current limiting device as embodied in the invention. These include impact modifiers for preventing damage to the current limiting device, such as cracking upon sudden impact; flame retardants for preventing flame formation and/or inhibiting flame formation in the current limiting device; dyes and colorants for providing specific color components in response to customer requirements; UV screens for preventing reduction in component physical properties due to exposure to sunlight or other forms of UV radiation.

Figure 5:
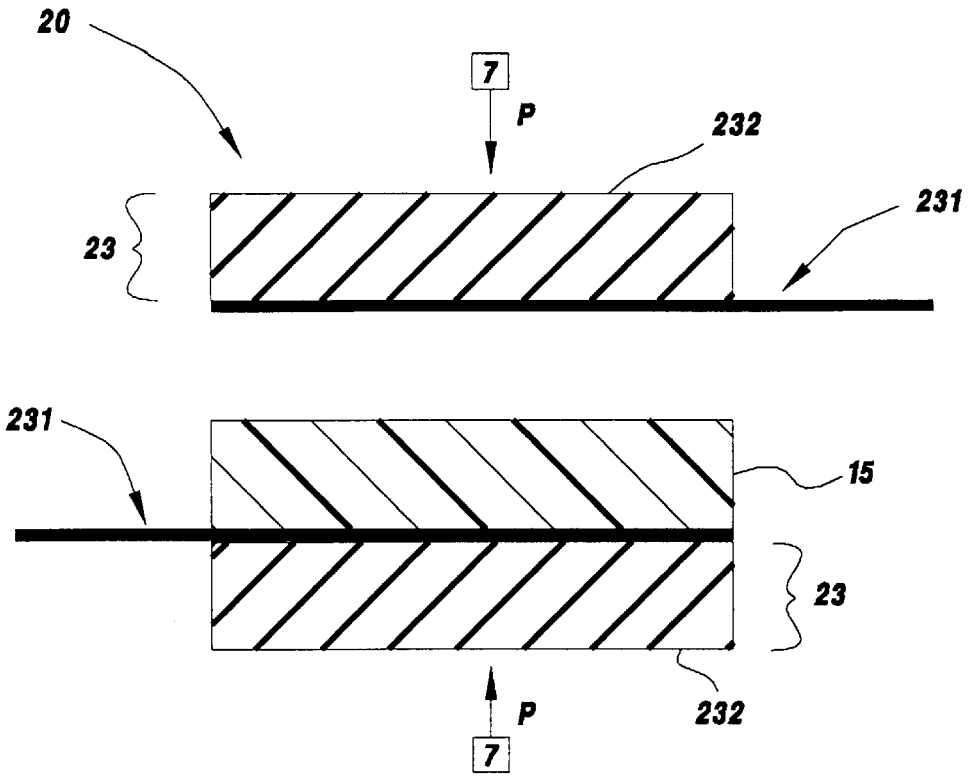
FIG. 5 is a side cross-sectional drawing of a second embodiment of the invention illustrating a flexible electrode current limiting device utilizing a thin metal foil as electrode and a backing of a flexible material.

FIG. 5 illustrates a second embodiment of a current limiting device 20, as embodied in the invention. In FIG. 5, the current limiting device 20 comprises at least one multi-component flexible electrode 23 and a polymer conductive composite material 15. In the descriptions of the embodiments, only one of the flexible electrodes are discussed, however it should be clear that the description is applicable to each flexible electrode.

The flexible electrode 23 comprises a thin metal foil 231, which acts as an electrode, and a backing 232, formed from a suitable flexible material. The thin metal foil 231 is formed from any suitable conductive material, such as but not limited to a metal, alloy, semiconductor or other appropriate conductive material, which can be formed into a foil. The flexible electrode 23 is formed of a single foil layer. Alternatively, the flexible electrode 23 is formed from a plurality of foil layers.

The flexible backing material 232 is formed from any suitable flexible material, natural or man-made. The flexible backing material 232 is, for example but not limited to, a silicone rubber, an elastomer, such as but not limited to silicone (polyorganosiloxane), (poly)urethane, isoprene rubber, and neoprene.

Figure 6:
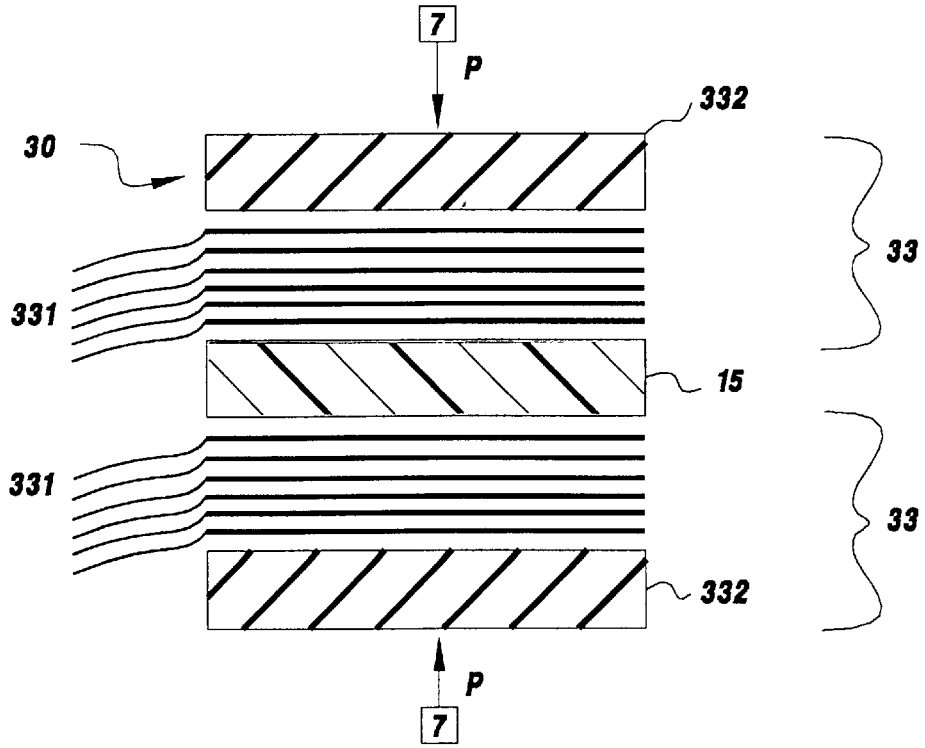
FIG. 6 is a side cross-sectional drawing of a third embodiment of the invention illustrating a flexible electrode current limiting device with a series of thin metal foil electrodes backed with a metal electrode.

FIG. 6 illustrates a third embodiment of a current limiting device, as embodied in the invention. The current limiting device 30 of FIG. 6 includes at least one flexible electrode 33 and a polymer conductive composite material 15.

The flexible electrode 33 comprises a plurality of thin metal foils 331, which acts as an electrode component, and a backing, which is formed as a standard stiff metal backing electrode 332. The standard stiff metal electrode 332 is constructed from any suitable conductive material, as known in the art. The thin metal foils 331 are also formed from any suitable conductive material, as long as they maintain a degree of flexibility.

Figure 7:
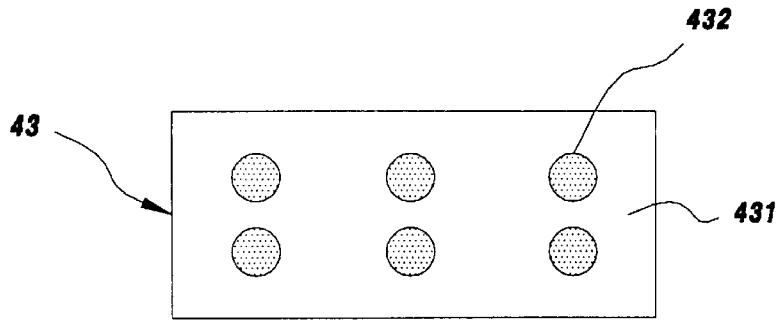
FIG. 7 is a top cross-sectional drawing of a fourth embodiment of the invention illustrating a flexible electrode current limiting device utilizing at least one composite electrode formed with alternating regions of flexible material and conductive material.
Figure 8:
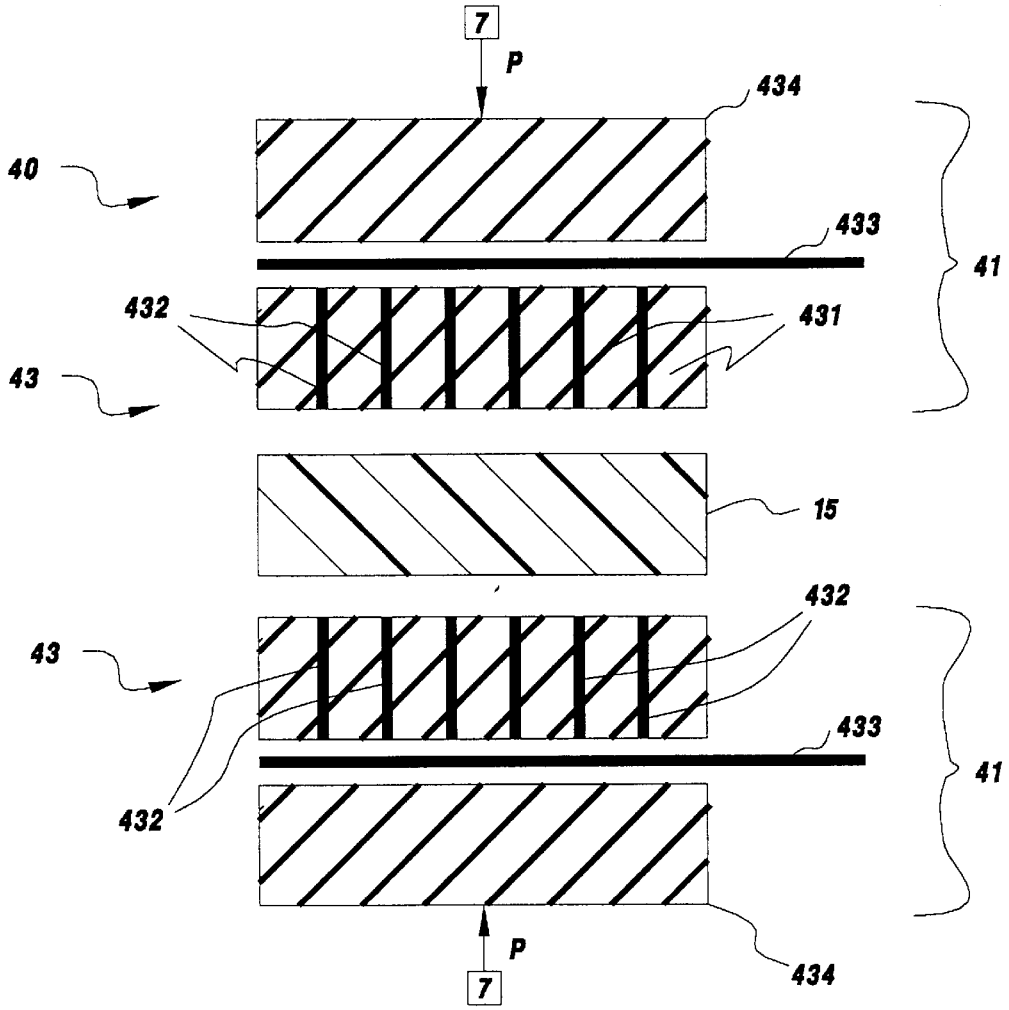
FIG. 8 a side cross-sectional drawing of the fourth embodiment of the invention.

FIGS. 7 and 8 illustrate a current limiting device, as embodied in a fourth embodiment of the invention. In FIGS. 7 and 8, the current limiting device 40, comprises at least one electrode assembly 41 and a polymer conductive composite material 15.

The electrode assembly 41 comprises a composite electrode 43 with alternating, interdespersed regions of flexible material 431 and metal inserts 432, as illustrated in FIGS. 7 and 8. While FIGS. 7 and 8 illustrate the metal inserts 432 in the form of circular cross-section cylinders, the metal inserts 432 are formed in any appropriate shape. Alternatively, the metal inserts 432 are constructed from any appropriate conductive material, as known in the art.

The flexible material 431 are formed from any suitable flexible material, natural or man-made. The flexible backing material 431 is, for example but not limited to, a silicone rubber, an elastomer, such as but not limited to silicone (polyorganosiloxane), (poly)urethane, isoprene rubber, and neoprene. Further, as embodied in the invention, the flexible backing material is formed, at least in part, from a conductive flexible material.

As illustrated in FIG. 8, a thin electrode foil 433 is positioned between the composite electrode 43 and a resilient backing member 434. The thin metal foils 433 is formed from any suitable conductive material, either a metal, alloy, semiconductor or other appropriate conductive foil material, in a similar fashion as discussed above. Further, the thin electrode foil 433 is a single foil, or alternatively a series of foils, such as for example illustrated in FIG. 6.

The resilient backing member 434 is formed from a resilient material, that is formed of any suitable resilient material. For example, the flexible backing material 434 is formed from any appropriate flexible material, natural or man-made, such as but not limited to, a silicone rubber and an elastomer, which may be a silicone (polyorganosiloxane), (poly)urethane, isoprene rubber, and neoprene.

Figure 9:
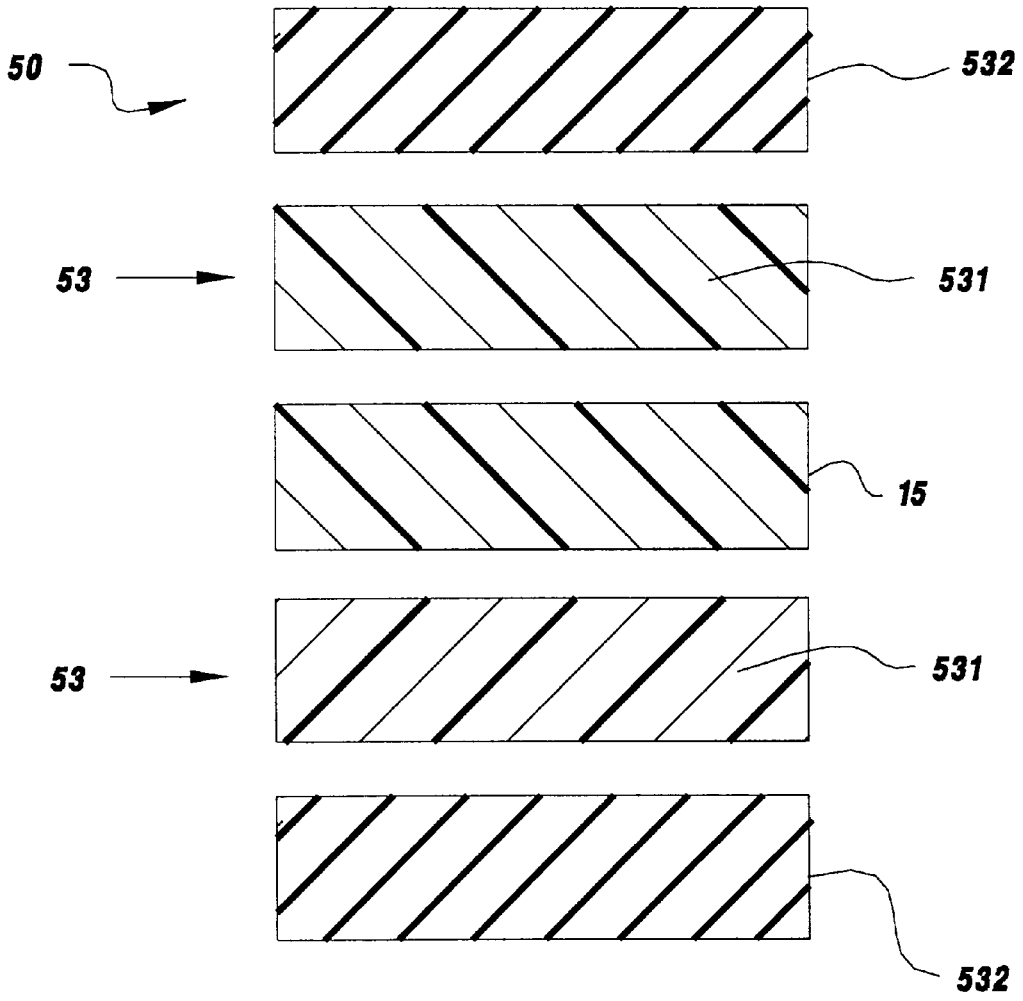
FIG. 9 is a side cross-sectional drawing of a fifth embodiment of the invention illustrating a flexible electrode current limiting device with at least one conductive flexible elastic-like material electrode backed with a metal electrode;.

FIG. 9 illustrates a fifth embodiment of a current limiting device. As embodied in FIG. 9, the current limiting device 50 includes at least one flexible electrode 53 and a polymer conductive composite material 15.

The flexible electrode 53 comprises at least one flexible material layer 531 impregnated with conductive particles that acts as an electrode component, and a backing, which is formed as a standard stiff metal backing electrode 532. The standard stiff metal electrode 532 is constructed from any suitable conductive material, as known in the art. Although FIG. 9 illustrates only one flexible material layer 531 on each side of the polymer conductive composite material 15, the invention includes in its scope any number of layers of flexible material 531, dependent on the intended use of the current limiting device 50.

The material of the flexible electrode 53 is formed from any suitable flexible material, natural or man-made. The material of the flexible electrode 53 comprise, for example but not limited to, a silicone rubber, an elastomer, such as but not limited to silicone (polyorganosiloxane), (poly)urethane, isoprene rubber, and neoprene, all of which are impregnated with conductive particles.

The invention contemplates that combinations of flexible electrodes as set forth in the above description of the embodiments may be used together. Further, invention also contemplates that current limiting devices, as embodied in the invention, electrically conducting materials other than metals, such as but not limited to ceramics and intrinsically conducting polymers, can be used for conductive features of the invention.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A current limiting device comprising:

at least two electrodes, at least one of the at least two electrodes comprising a flexible electrode, the flexible electrode being compliant and comprising at least one composite electrode and at least one electrode foil abutting thereto, the at least one composite electrode comprising interdispersed, rigid, metal insert cylinders and alternating regions of flexible material;

an electrically conductive composite material between said at least two electrodes, the conductive composite material being in physical and electrical contact with said at least one flexible electrode, said composite material comprising a low pyrolysis temperature binder, and an electrically conductive filler, said at least two electrodes and said composite material being in contact at an interface between each electrode and the composite material; and an inhomogeneous distribution of resistance structure comprising contact resistance at each said interface, wherein during a high current condition, the at least one flexible electrode and the composite material at an interface are separated by at least a partial physical separation caused by the generation of gas by the conductive composite material, and the composite material comprising at least one partial separation area caused by the generation of gas where some electrically conductive composite material is consumed after the high current condition, wherein the at least one flexible electrode is flexible so as to return to physical and electrical contact with the composite material at the partial separation area.

2. The device according to claim 1, wherein the at least one flexible electrode comprises a plurality of flexible electrodes layered together.

3. The device according to claim 1, wherein the electrode foil comprises a single electrode foil layer.

4. The device according to claim 3, wherein the electrode foil comprises a plurality of electrode foil layers layered together.

5. The device according to claim 4, further comprising a stiff metal backing electrode abutting together with the plurality of electrode foil layers.

6. The device according to claim 1, further comprising a flexible backing abutting the at least one flexible electrode.

7. The device according to claim 6, wherein the at least one flexible backing comprises silicon rubber.

8. The device according to claim 1, wherein the at least one electrode foil comprises at least one single electrode foil layer.

9. The device according to claim 1, wherein the electrode foil comprises a plurality of electrode foil layers layered together.

10. The device according to claim 1, further comprising at least one flexible backing abutting the flexible electrode, the flexible backing comprises silicone rubber.

11. The device according to claim 4, wherein the at least one flexible backing comprises at least one elastomer selected from the group consisting of; silicone rubber, polyorganosiloxane, (poly)urethane, isoprene rubber, and neoprene, all of which are impregnated with conductive particles.

12. A method of limiting current using a current limiting device that comprises: at least two electrodes, at least one of the at least two electrodes comprising a flexible electrode, the flexible electrode being compliant; an electrically conductive composite material between said at least two electrodes, the conductive composite material being in physical and electrical contact with said at least one flexible electrode, said composite material comprising a low pyrolysis temperature binder, and an electrically conductive filler, said at least two electrodes and said composite material being in contact at an interface between each electrode and the composite material; means for exerting compressive pressure on the conductive material and the flexible electrode; and an inhomogeneous distribution of resistance structure comprising contact resistance at each said interface, the method comprising:

establishing a high current condition;

applying a voltage resulting from the high current condition to one of the electrodes;

ablating portions of the electrically conductive composite material and generating gas from the ablation of the electrically conductive composite material and consuming portions of the electrically conductive composite material after the high current condition to form a cratered surface on the electrically conductive composite material; and at least partially separating the at least one flexible electrode and the composite material at an interface so as to define a partial separation area so as to limit current, where the gas generation causes the at least partial separation of the at least one flexible electrode and the composite material at the interface;

forcing the at least one flexible electrode to assume the shape of the cratered surface and to return to physical and electrical contact with the composite material at the partial separation area.

13. The method according to claim 12, wherein the at least one flexible electrode comprises a plurality of flexible electrodes layered together.

14. The method according to claim 12, wherein the at least one flexible electrode comprises an electrode foil.

15. The method according to claim 14, wherein the electrode foil comprises a single electrode foil layer.

16. The method according to claim 15, wherein the electrode foil comprises a plurality of electrode foil layers layered together.

17. The method according to claim 16, further comprising a stiff metal backing electrode abutting the plurality of elutrode foil layers.

18. The method according to claim 14, further comprising a flexible backing abutting the at least one flexible electrode.

19. The method according to claim 18, wherein the at least one flexible backing comprises silicon rubber.

20. The method according to claim 12, wherein the at least one flexible electrode comprises at least one composite electrode and at least one electrode foil abutting thereto.

21. The method according to claim 20, wherein the at least one composite electrode further comprises a flexible material with interdispersed insert conducting regions.

22. The method according to claim 20, wherein the at least one electrode foil comprises at least one single electrode foil layer.

23. The method according to claim 20, wherein the electrode foil comprises a plurality of layered electrode foil layer.

24. The method according to claim 20, further comprising at least one flexible backing, the flexible backing comprises silicone rubber.

25. The method according to claim 21, the interdispersed insert conducting regions being inflexible.

26. The method according to claim 12, the at least one flexible electrode comprising at least one flexible material layer impregnated with conductive particles and a stiff metal backing electrode.

27. The method according to claim 26, wherein the at least one flexible electrode comprises at least one of a silicone rubber, an elastomer, polyorganosiloxane, (poly)urethane, isoprene rubber, and neoprene, all of which are impregnated with conductive particles.

* * * * *